US008905785B2

(12) United States Patent
Johnescu et al.

(10) Patent No.: US 8,905,785 B2
(45) Date of Patent: Dec. 9, 2014

(54) ELECTRICAL CONNECTOR HAVING CONDUCTIVE HOUSING

(75) Inventors: Douglas M. Johnescu, York, PA (US); Jonathan E. Buck, Hershey, PA (US)

(73) Assignee: FCI Americas Technology LLC, Carson City, NV (US)

( * ) Notice: Subject to any disclaimer, the term of this patent is extended or adjusted under 35 U.S.C. 154(b) by 80 days.

(21) Appl. No.: 13/519,413

(22) PCT Filed: Dec. 17, 2010

(86) PCT No.: PCT/US2010/060995

§ 371 (c)(1), (2), (4) Date: Oct. 10, 2012

(87) PCT Pub. No.: WO2011/090632

PCT Pub. Date: Jul. 28, 2011

(65) Prior Publication Data

US 2013/0189858 A1 Jul. 25, 2013

Related U.S. Application Data

(60) Provisional application No. 61/291,005, filed on Dec. 30, 2009.

(51) Int. Cl.

*H01R 13/648* (2006.01)
*H01R 13/6471* (2011.01)
*H01R 13/658* (2011.01)

(52) U.S. Cl.

CPC ..... *H01R 13/6471* (2013.01); *H01R 13/65807* (2013.01); *Y10S 439/931* (2013.01)
USPC ..... 439/607.03; 439/931

(58) Field of Classification Search

USPC ..... 439/607.03, 607.02, 607.12, 931
See application file for complete search history.

(56) References Cited

U.S. PATENT DOCUMENTS

| | | | | |
|---|---|---|---|---|
| 5,037,332 | A * | 8/1991 | Wilson | 439/607.03 |
| 5,344,341 | A * | 9/1994 | Yoshino | 439/607.03 |
| 6,123,584 | A * | 9/2000 | Van Koetsem et al. | 439/607.02 |
| 6,159,048 | A * | 12/2000 | Van Koetsem et al. | 439/607.03 |
| 6,168,469 | B1 | 1/2001 | Lu | |
| 6,471,548 | B2 | 10/2002 | Bertoncini et al. | |
| 6,485,330 | B1 | 11/2002 | Doutrich | |
| 6,544,072 | B2 * | 4/2003 | Olson | 439/607.02 |
| 7,371,117 | B2 | 5/2008 | Gailus | |
| 7,811,100 | B2 | 10/2010 | Stoner | |
| 7,811,134 | B2 | 10/2010 | Bixler et al. | |
| 8,414,332 | B2 * | 4/2013 | Ju et al. | 439/607.02 |
| 2007/0004282 | A1 * | 1/2007 | Cohen et al. | 439/608 |
| 2008/0233806 | A1 | 9/2008 | Rothermel et al. | |
| 2009/0221165 | A1 | 9/2009 | Buck et al. | |
| 2009/0291593 | A1 | 11/2009 | Atkinson et al. | |

* cited by examiner

*Primary Examiner* — Gary Paumen
(74) *Attorney, Agent, or Firm* — Baker & Hostetler LLP

(57) ABSTRACT

An electrical connector includes a conductive connector housing that supports a plurality of contact modules that includes electrical ground contacts and electrical signal contacts electrically isolated from each other in the respective contact modules. The electrical ground contacts are in electrical communication with the connector housing so as to electrically common the ground contacts together.

18 Claims, 6 Drawing Sheets

ELECTRICAL CONNECTOR HAVING CONDUCTIVE HOUSING

CROSS-REFERENCE TO RELATED APPLICATIONS

This application is the National Stage of International Application No. PCT/US2010/060995, filed Dec. 17, 2010, which claims the benefit of U.S. Provisional Application No. 61/291,005 filed Dec. 30, 2009, the disclosures of which are incorporated herein by reference in their entireties.

BACKGROUND

Electrical connectors typically include a connector housing that supports a plurality of electrical contacts, which can include a plurality of signal contacts and a plurality of ground contacts. Often, the signal contacts are so closely spaced that undesirable interference, or "cross talk," occurs between adjacent signal contacts. Cross talk occurs when one signal contact induces electrical interference in an adjacent signal contact due to intermingling electrical fields, thereby compromising signal integrity. With electronic device miniaturization and high speed, high signal integrity electronic communications becoming more prevalent, the reduction of cross talk becomes a significant factor in connector design.

SUMMARY

In accordance with one aspect of the present disclosure, a conductive connector housing places ground contacts that are spaced along a column direction and a row direction in electrical communication with one another, while simultaneously electrically isolating the signal contacts from the ground contacts. In accordance with one embodiment, an electrical connector includes a connector housing having a support wall that is electrically conductive. The electrical connector further includes at least one contact module supported by the support wall. The contact module includes at least one ground contact that is in electrical communication with the support wall, and at least one signal contact that is electrically isolated from both the support wall and the at least one ground contact. The electrically conductive support wall helps to reduce crosstalk between differential signal pairs in a column direction and helps to reduce crosstalk between differential signal pairs in a direction perpendicular to the column direction.

BRIEF DESCRIPTION OF THE DRAWINGS

The foregoing summary, as well as the following detailed description of a preferred embodiment, are better understood when read in conjunction with the appended diagrammatic drawings. For the purpose of illustrating an electrical connector having a conductive housing, the drawings show an embodiment that is presently preferred. The invention is not limited, however, to the specific instrumentalities disclosed in the drawings. In the drawings.

DETAILED DESCRIPTION

Figure 1:
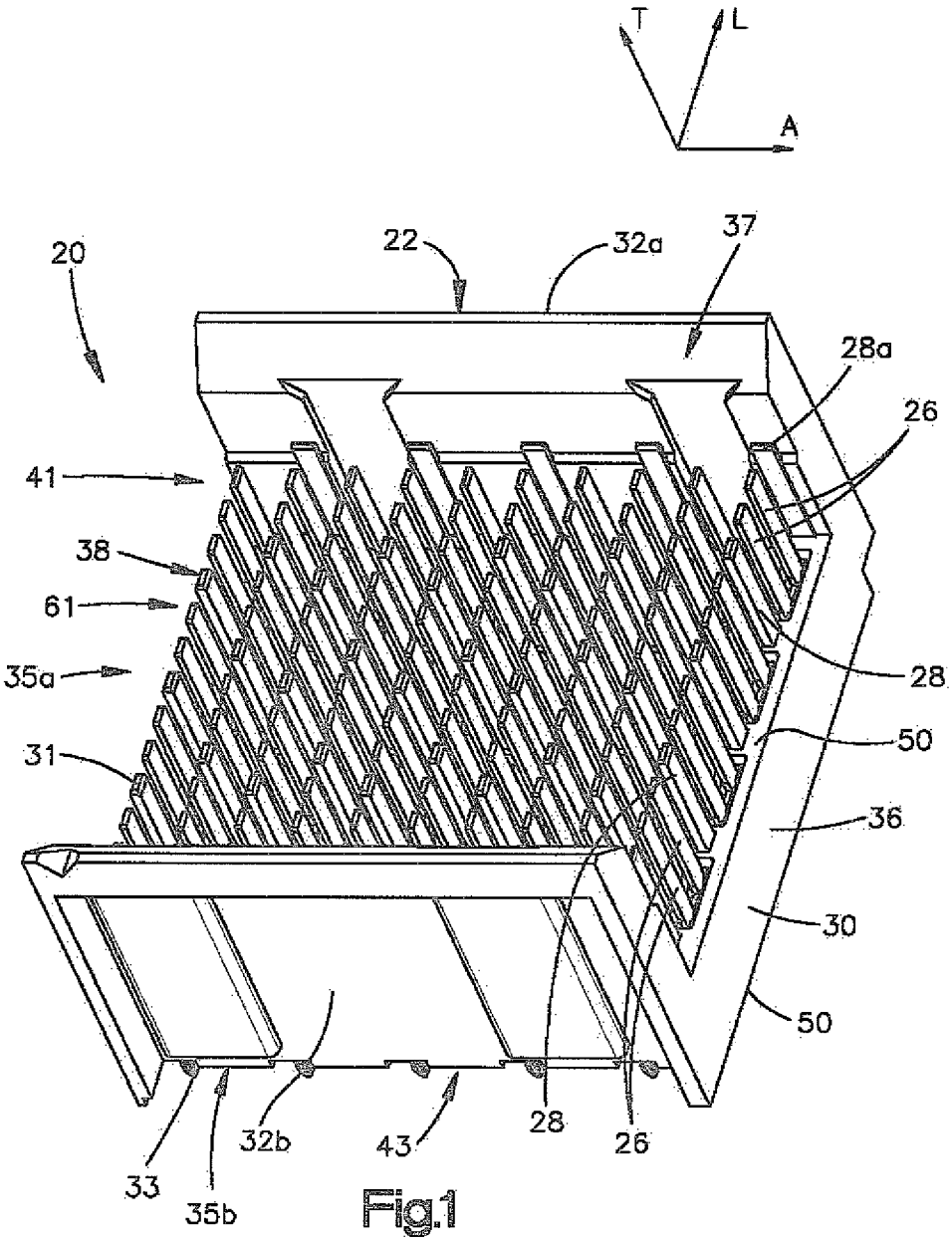
FIG. 1 is a perspective view of an electrical connector constructed in accordance with one embodiment, including a connector housing supporting a plurality of contact modules.
Figure 2:
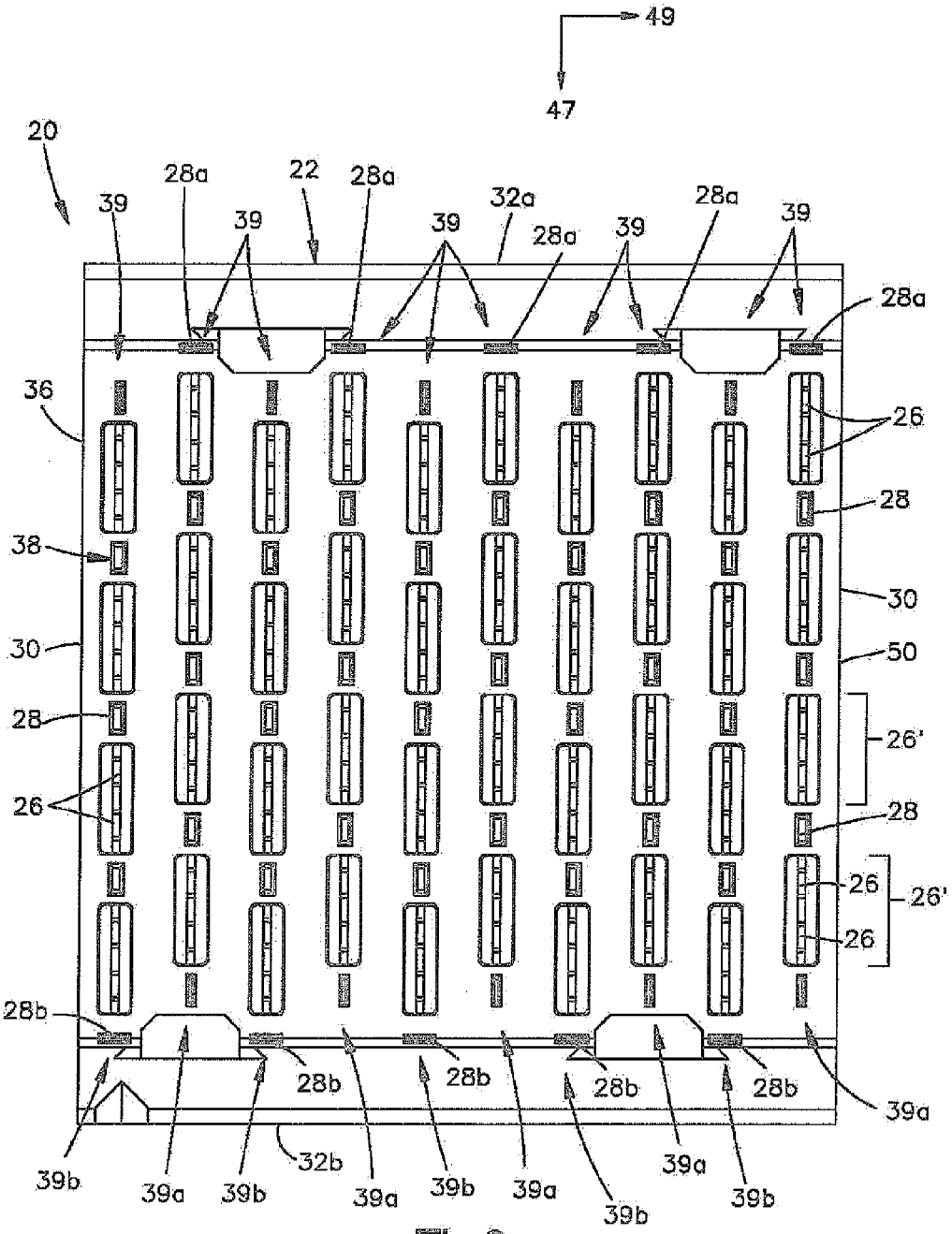
FIG. 2 is a top plan view of the electrical connector illustrated in FIG. 1.
Figure 4:
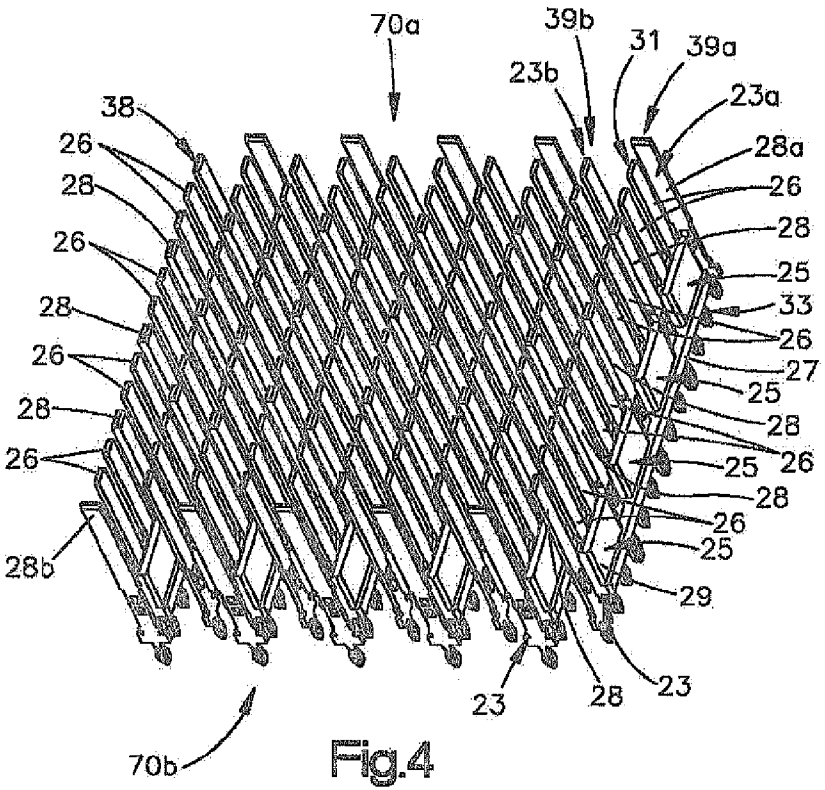
FIG. 4 is a perspective view of an array of electrical contacts of the electrical connector illustrated in FIG. 1.
Figure 3:
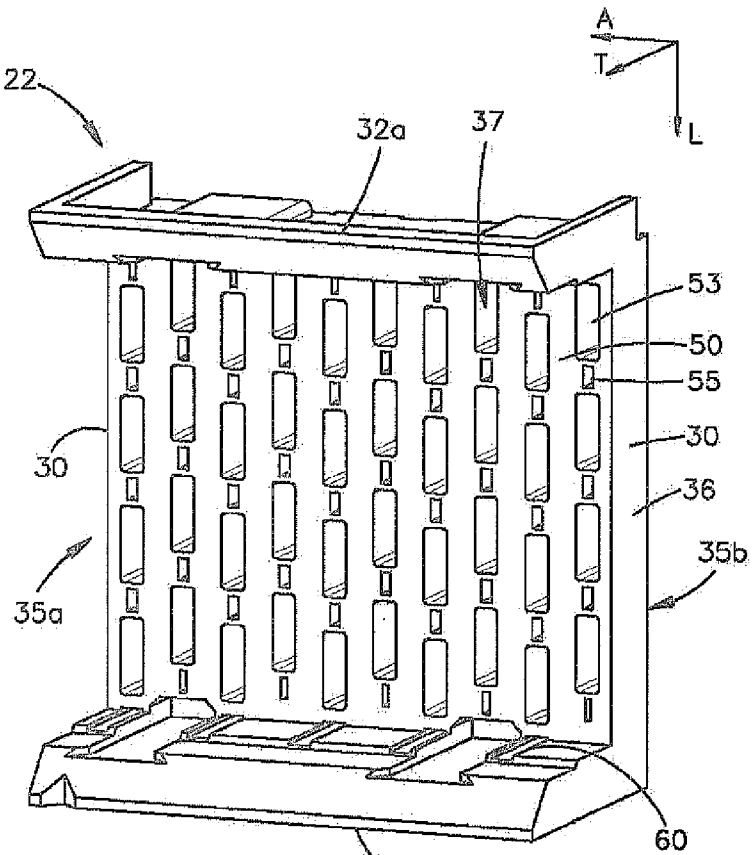
FIG. 3 is a perspective view of the connector housing illustrated in FIG. 1.

Referring to FIGS. 1 and 2, an electrical connector 20 includes a connector housing 22 and a plurality of electrical contacts 38. The connector housing 22 defines a frame 36 including a first end wall 32*a* and a second opposed end wall 32*b* spaced from the first end wall 32*a* along a longitudinal direction L, a pair of opposed side walls 30 that are spaced apart along a lateral direction A that is substantially perpendicular to the longitudinal direction L, and are connected between the first and second end walls 32*a-b* so as to define a contact receiving space 37. The connector housing 22 further defines a top end 35*a* and an opposed bottom end 35*b* spaced from the top end 35*a* along a transverse direction T that is substantially perpendicular with respect to the longitudinal direction L and the lateral direction A. In accordance with the illustrated embodiment, the transverse direction T is oriented vertically, and the longitudinal and lateral directions L and A are oriented horizontally, though it should be appreciated that the orientation of the electrical connector 20 may vary during use. Thus, the electrical connector 20 and its components are described herein in the illustrated orientation, it being appreciated that the actual orientation of the electrical connector 20 can vary during use. In accordance with the illustrated embodiment, the end walls 32*a-b* extend upward from the side walls 30.

The connector housing 22 further includes a support wall 50 that supports the electrical contacts 38. The support wall 50 can be disposed proximate to the lower end 35*b* as illustrated, or can alternatively be located anywhere on the connector housing 22 as desired. The electrical connector 20 defines a mating interface 41 disposed proximate to the top end 35*a* and a mounting interface 43 disposed proximate to the bottom end 35*b*. The electrical connector 20 is configured to be mounted to a complementary electrical component, such as a complementary substrate or printed circuit board, at the mounting interface 43, and is configured to mate with a complementary electrical component, such as a complementary electrical connector, at the mating interface 41.

The electrical connector 20 includes a plurality of electrical contacts 38 that are carried by the connector housing 22 and are at least partially disposed in the contact receiving space 37. The electrical contacts 38 each define respective mating ends 31 and opposed respective mounting ends 33 spaced from the mating ends 31 along the transverse direction T. The mating ends 31 are disposed proximate to the mating interface 41, and are configured to mate with complementary electrical contacts of the complementary electrical component, such as the complementary electrical connector. The mounting ends 33 are disposed proximate to the mounting interface 43, and are configured to electrically connect with complementary electrical traces of the complementary electrical component, such as the complementary substrate or printed circuit board. The mounting ends 33 can define press-fit terminals, surface mounted terminals, or any alternative terminal suitable for connection to the complementary electrical component.

The mounting ends 33 of the electrical contacts 38 are configured to electrically connect with electrical traces of an underlying substrate or printed circuit board when the electrical connector 20 is mounted to the underlying printed circuit board, and the mating ends 31 are configured to electrically connect to complementary electrical contacts of the electrical device to which the electrical connector 20 is mated. Thus, the electrical connector 20 is configured to place the printed circuit board to which the electrical connector 20 is mounted in electrical communication with the complementary electrical device to which the electrical connector 20 is mated.

The mating ends 31 can be configured as blades that are configured to be received in complementary receptacles of the complementary electrical contacts. Thus, the electrical contacts 38 can be referred to as header contacts. Alternatively, the electrical contacts 38 can be configured as receptacle contacts whose mating ends 31 are configured to receive complementary header contacts, or hermaphroditic contacts as desired.

Furthermore, in accordance with the illustrated embodiment, the mating interface 41 is oriented substantially parallel to the mounting interface 43, such that the electrical connector 20 can be referred to as a vertical electrical connector. Alternatively, the electrical connector 20 can be configured as a right-angle electrical connector whereby the mating interface 41 is oriented substantially perpendicular with respect to the mounting interface 43. Likewise, in accordance with the illustrated embodiment, the mating ends 31 are oriented substantially parallel to the mounting ends 33, such that the electrical contacts 38 can be referred to as vertical electrical contacts. Alternatively, the electrical contacts 38 can be configured as right-angle electrical contacts whereby the mating ends 31 are oriented substantially perpendicular with respect to the mounting ends 33.

The electrical connector 20 includes a plurality of contact modules 23 that support the electrical contacts 38 along respective longitudinal columns 39 that can extend along the respective centerlines of the electrical contacts 38 supported by a given contact module 23 along respective longitudinal column directions 47. Each contact module 23 includes a dielectric, insulative, or electrically non-conductive lossy base 27 that can be provided as a longitudinally elongate rib that extends along the respective column 39 and supports a plurality of electrical contacts 38. The columns 39 are laterally spaced from each other along a row direction 49 that extends substantially perpendicular to the longitudinal or column direction 47. In accordance with the illustrated embodiment, the electrical contacts 38 of each contact module 23 that are supported by the base 27 can include at least one signal contact 26 such as a plurality of signal contacts 26, and at last one ground contact 28 such as a plurality of ground contacts 28 that can be arranged as desired along a respective column 39. As will be appreciated from the description below, the ground contacts 28 are electrically isolated from both each other and the plurality of signal contacts in the contact module.

In accordance with the illustrated embodiment, adjacent pairs of signal contacts 26 along a respective column 39 can define differential signal pairs 26'. Alternatively, the signal contacts 26 can be single-ended. The ground contacts 28 can be disposed adjacent a signal contact 26, and can be disposed between adjacent signal contacts 26. For instance, the ground contacts 28 can be disposed between adjacent pairs of differential signal pairs 26'. Accordingly, a given ground contact 28 can be disposed between a first pair of adjacent signal contacts 26 and a second pair of adjacent signal contacts 26.

For instance, each contact module 23 includes at least one leadframe assembly 25, such as a plurality of leadframe assemblies 25 that are longitudinally spaced from each other along respective columns 39. Each leadframe assembly 25 includes a leadframe housing 29 that can be dielectric or insulative and supports at least one electrical contact 38, such as a pair of electrical contacts 38, such that the mating ends 31 and the opposed mounting ends 33 extend out from the leadframe housing 29. The mounting ends 33 further extend through the base 27. The electrical contacts 38 can be stitched into or otherwise supported by the leadframe housing 29, or the leadframe housing 29 is overmolded onto the electrical contacts 38 such that the leadframe assembly 25 defines an insert molded leadframe assembly (IMLA). Each contact module 23 can include as many leadframe assemblies 25 as desired. Furthermore the base 27 can be integral with the leadframe assemblies 25, or otherwise discreetly connected to the leadframe assemblies 25.

While each contact module 23 includes four leadframe assemblies 25 as illustrated, it should be appreciated that the contact module 23 can alternatively include any number of leadframe assemblies 25 as desired. Furthermore, while each leadframe assembly 25 of a given column 39 forms part of the same contact module 23, it should be appreciated that any number of contact modules can extend along the given column 39.

The at least one electrical contact 38, such as a pair of electrical contacts 38, of each of the leadframe assemblies 25 can be provided as signal contacts 26. Accordingly, it can be said that the leadframe housing 29 supports at least one signal contact 26 such as a pair of signal contacts 26. The pair of signal contacts 26 of each leadframe assembly 25 can define a differential signal pair. Alternatively, the signal contacts 26 can be single ended. In accordance with one embodiment, each of the leadframe assemblies 25 and the base 27 are overmolded onto the respective signal contacts 26 so as to define a unitary structure that includes the leadframe assemblies 25 and the base 27. While each leadframe assembly 25 is illustrated as including a pair of signal contacts 26, the leadframe assemblies 25 can each alternatively include any number of signal contacts 26 as desired. While the leadframe assemblies 25 are illustrated as including only signal contacts 26, it should be further appreciated that the leadframe assemblies 25 can alternatively include one or more ground contacts 28 as desired.

Figure 6C:
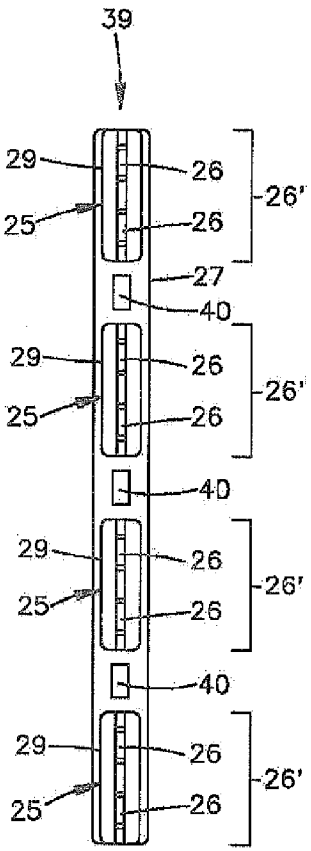
FIG. 6C is a top plan view of the contact module illustrated in FIG. 6B.
Figure 5:
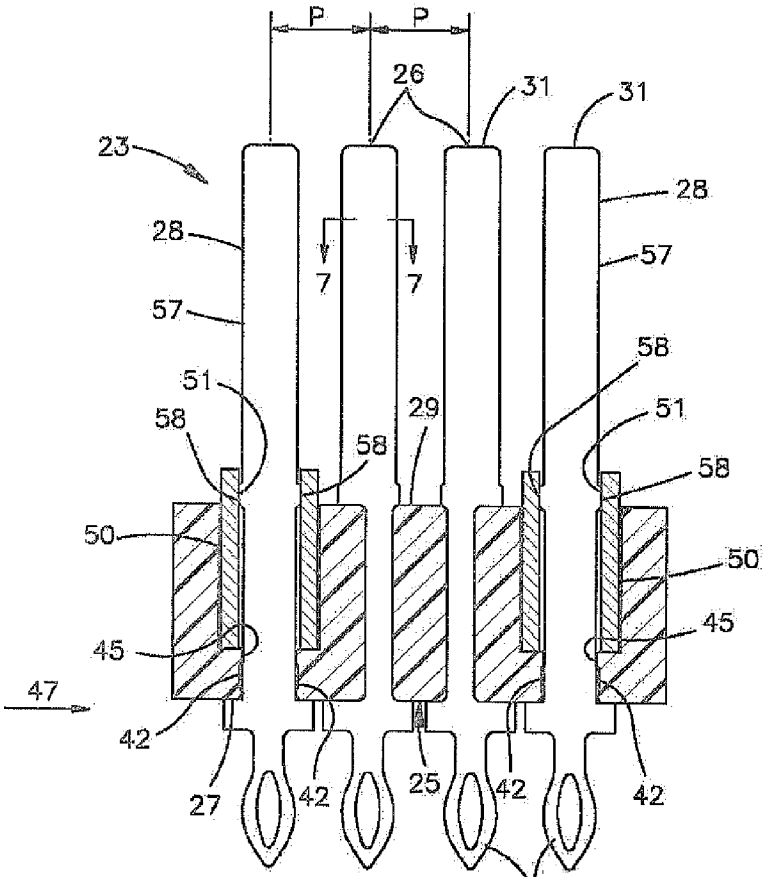
FIG. 5 is a sectional side elevation view of a portion of the electrical connector illustrated in FIG. 1.
Figure 6B:
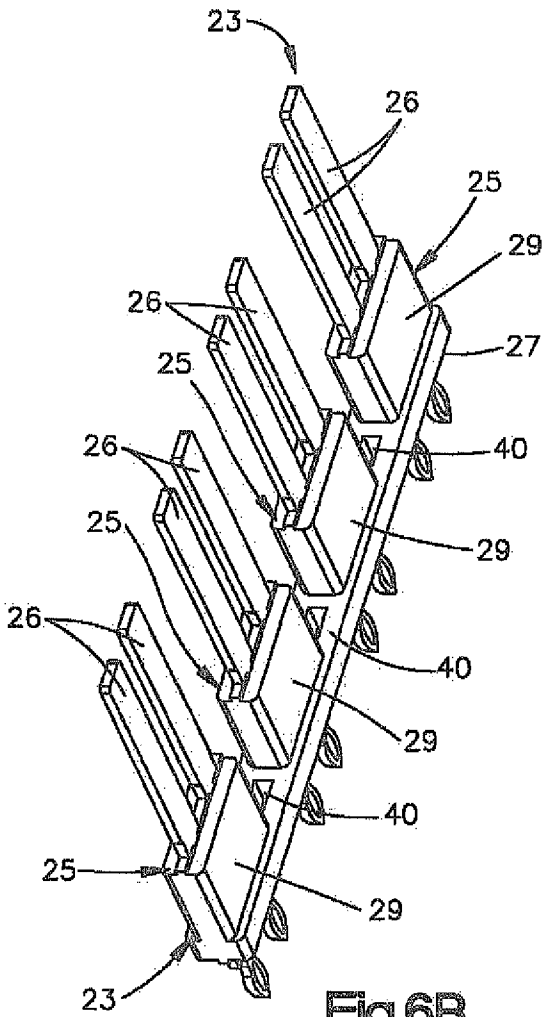
FIG. 6B is a perspective view of one of the plurality of contact modules illustrated in FIG. 6A.
Figure 6A:
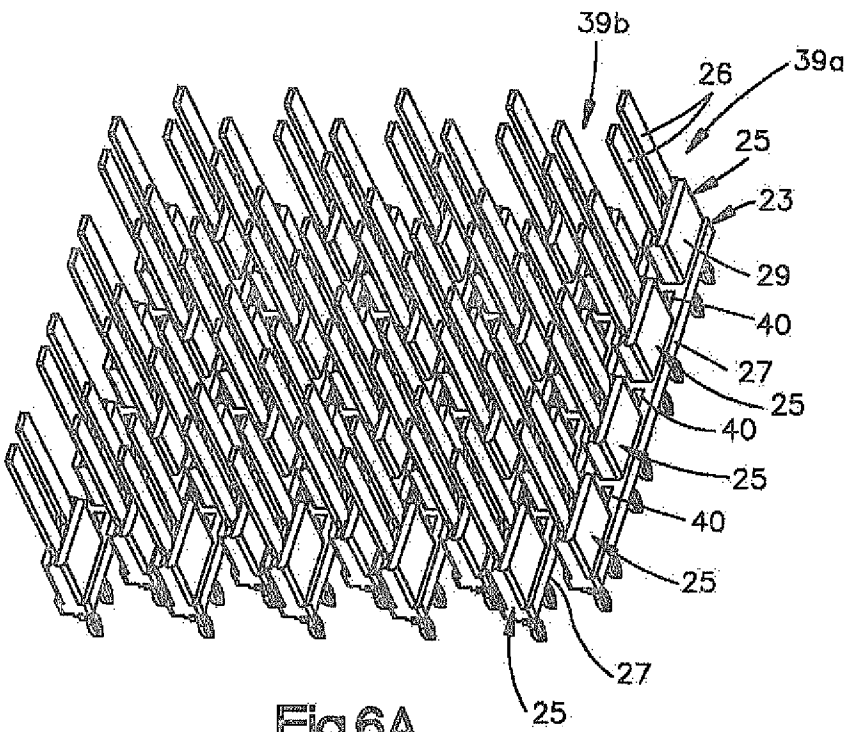
FIG. 6A is a sectional side elevation view of the plurality of contact modules illustrated in FIG. 1, shown with ground contacts removed.

Referring also to FIG. 5-6C, each contact module 23 can further include at least one ground contact 28 that is supported by the base 27 at a location between adjacent leadframe assemblies 25. For instance, each contact module 23 can define at least one retention aperture 40 such as a plurality of retention apertures 40 that extend transversely through the base 27. For instance, the retention apertures 40 can be disposed at a location between adjacent leadframe assemblies 25, and at least one of the retention apertures 40 can further be disposed laterally outward with respect to one or both of the outermost leadframe assemblies 25. Accordingly, the base 27 defines an inner surface 45 that defines a perimeter of each of the corresponding retention apertures 40. The retention apertures 40 can be cylindrical or alternatively shaped as desired so as to receive and retain the ground contacts 28.

In accordance with the illustrated embodiment, the ground contacts 28 each define a ground contact body 57, such that the mounting ends 33 extend down from the contact body 57.

Each ground contact 28 can further include at least one such as a plurality of retention members that are configured to engage the inner surface 45 of the base 27 inside the retention apertures 40. In accordance with the illustrated embodiment, the retention members of the ground contacts 28 are in the form of one or more retention barbs 42 that project out from the ground contact body 57 and thus define an outer dimension slightly greater than the cross-sectional dimension of the respective ground contact body 57. Furthermore, the retention barbs 42 can define an outer dimension slightly greater than or substantially equal to the cross-sectional dimension of the retention apertures 40. Otherwise stated, the retention apertures 40 can have a cross-sectional dimension slightly less than or equal to the outer dimension of the retention barbs 42. Accordingly, the ground contacts 28 are configured to be press-fit in the retention apertures 40. Accordingly, each of the plurality of ground contacts 28 of each contact modules 23 can extend through respective ones of the plurality of retention apertures 40 and is secured to the base 27 in the retention apertures 40.

Alternatively, the ground contacts 28 can be devoid of retention members, and the base 27 can include retention members, such as barbs, that extend into the retention aperture 40 from the respective inner surface 45, and engage the ground contact body 57 so as to retain the ground contact 28 in the retention aperture 40. Alternatively, both or neither of the ground contacts 28 and the inner surfaces 45 can include retention members that engage the other of the respective ground contacts 28 and inner surfaces so as to retain the ground contacts 28 in their respective retention apertures 40. For instance, the ground contact body 57 can be sized substantially equal to or slightly greater than the respective retention apertures 40, and thus configured to be press-fit in the retention apertures 40.

The ground contacts 28 can alternatively be otherwise attached to the base 27 in the retention apertures 40. For instance, the ground contacts 28 can be stitched into or overmolded by the base 27. When the ground contacts 28 are retained by the base 27, the mounting ends 33 extend below the base 27 and the mating ends 31 extend above the base 27, and can be inline with the mounting ends 33 and mating ends 31, respectively, of the signal contacts 26 along the longitudinal column direction 47. Alternatively, the mating ends 31 of the ground contacts 28 can be shorter or longer than the signal contacts 33 as desired.

In accordance with the illustrated embodiment, the retention apertures 40 are disposed substantially equidistantly with respect to the adjacent leadframe assemblies 25, and thus the corresponding signal contacts 26. Thus, the ground contacts 28 are spaced substantially equidistantly with respect to the adjacent signal contacts 26 of the adjacent leadframe assemblies 25. The signal contacts 26 of a respective leadframe assembly 25 are spaced apart a distance substantially equal to the distance between the ground contacts 28 and the signal contacts 26 that are adjacent the ground contacts 28. Accordingly, at least a portion up to all of the electrical contacts 38 can be substantially equidistantly spaced along the respective columns 39. Otherwise stated, the electrical contacts 38 define a column pitch P, that is the distance between the centerlines of adjacent electrical contacts 38 along the respective column, that can be substantially constant along the respective columns 39.

Figure 7:
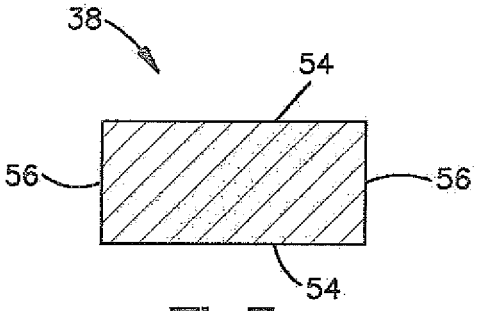
FIG. 7 is a sectional end elevation view of an electrical contact taken along line 7-7 of FIG. 5.

Referring also to FIG. 7, each of the electrical contacts 38 can define respective first and second opposed broadsides 54 and first and second edges 56 connected between the broadsides. The edges 56 define a length less than that of the broadsides 56, such that the electrical contacts 38 define a substantially rectangular cross section. In accordance with the illustrated embodiment, the broadsides 54 extend longitudinally, or along a direction substantially parallel to the column 39. Thus, the edges 56 of adjacent electrical contacts 38, including adjacent signal contacts 26, can face each other along the respective column 39. Accordingly, when the adjacent signal contacts 26 define respective differential pairs, the adjacent signal contacts 26 can be referred to as edge-coupled signal contacts. Alternatively, the signal contacts 26 can be oriented such that the broadsides 54 of adjacent signal contacts 26 of a given differential pair face each other, such that the adjacent signal contacts 26 can alternatively be referred to as broadside-coupled signal contacts.

Thus, it should be appreciated that the electrical contacts 38 of a respective contact module 23 can be provided in any arrangement as desired along the respective column 39. In accordance with the illustrated embodiment, the electrical contacts 38 of at least one up to all of the contact modules 23 can be arranged in a repeating signal-signal-ground (S-S-G) pattern along the respective column 39, where "S" represents a signal contact 26, and "G" represents a ground contact 28. Accordingly, a ground contact 38 can be disposed between adjacent pairs of signal contacts 26, which can define respective differential signal pairs 26'.

The contact modules 23 can include a first plurality of contact modules 23*a* and a second plurality of contact modules 23*b* that are disposed adjacent to each other along the row direction 49 such that the first and second pluralities of contact modules 23*a* and 23*b* are alternatingly arranged along the row direction 49. Accordingly, referring also to FIG. 8, the electrical contacts 38 are arranged in an array 61 having a footprint defined by the columns 39 including a first plurality of columns 39*a* and a second plurality of columns 39*b* that are disposed adjacent to each other along the row direction 49, such that the first and second pluralities of columns 39*a* and 39*b* are alternatingly arranged along the row direction 49.

In accordance with the illustrated embodiment, the electrical contacts 28 of each column 39 are arranged in a repeating S-S-G pattern, such that the electrical contacts 28 of at least one up to all of the first plurality of columns 39*a* can be longitudinally staggered or offset along the column direction 47 with respect to at least one up to all of the electrical contacts 28 of the second plurality of columns 39*b*. Accordingly, at least a first column 39, such as a first plurality of columns 39*a*, can define a repeating S-S-G pattern, while at least a second column 39, such as a second plurality of columns 39*b*, can define a repeating S-S-G-S-S-G pattern that is offset with respect to the first plurality of columns 39*a* by one or more electrical contacts 38. The electrical connector 20 can further include respective outer ground contacts 28*a* and 28*b* at each column 39 located longitudinally outward of the outermost signal contact S.

For instance, each of the respective columns 39*a* and 39*b*, define first and second longitudinally opposed outer ends 70*a-b*, respectively, that are disposed proximate to the first and second end walls 32*a* and 32*b*, respectively. One of the first and second ends of a select one of the first and second pluralities of columns 39*a* and 39*b* can be outwardly recessed with respect to the respective outer end of the other of the first and second pluralities columns 39*a* and 39*b*, while the opposed outer end of the select one of the first and second pluralities of columns 39*a* and 39*b* is inwardly recessed with respect to the respective outer end of the other of the first and second pluralities of columns 39*a* and 39*b*.

For instance, in accordance with the illustrated embodiment, the first outer end 70*a* of each of the first plurality of columns 39*a* is outwardly recessed with respect to the first outer end 70*a* of each of the second plurality of columns 39*b*, and the second outer end 70*b* of each of the first plurality of columns 39*a* is inwardly recessed with respect to the second outer end 70*b* of each of the second plurality of columns 39*b*. Otherwise stated, the first outer end 70*a* of each of the second plurality of columns 39*b* is inwardly recessed with respect to the first outer end 70*a* of each of the first plurality of columns 39*a*, and the second outer end 70*b* of each of the second plurality of columns 39*b* is outwardly recessed with respect to the second outer end 70*b* of each of the first plurality of columns 39*a*.

In accordance with the illustrated embodiment, each of the first and second pluralities of columns 39*a* and 39*b* are offset from each other along their respective column direction 47 by the column pitch. Accordingly, a select ground contact 28 such as each ground contact 28 of a respective column 39 that is between adjacent leadframe assemblies 25 is inline with a signal contact 26 of an immediately adjacent column 39 along the row direction 49. It should be appreciated, alternatively, that the columns 39*a* and 39*b* can alternatively be offset by any dimension as desired. Alternatively still, the columns 39*a* and 39*b* can be inline with each other, such that the signal contacts 26 of each column 39*a* and 39*b* are aligned along the row direction 49, and each of the ground contacts 28 of each column 39*a* and 39*b* are aligned along the row direction. While each of the first and second pluralities of column 39*a* and 39*b* defines the same repeating S-S-G pattern of signal contacts 26 and ground contacts 28 along the respective column 39, the columns can alternatively define different contact patterns as desired.

Each column 39 can define at least one outermost electrical contact 38, such as an outermost ground contact 28, that is disposed proximate to one of the outer ends 70*a* and 70*b*. For instance, at least one up to all of the first plurality of columns 39*a* and 39*b* can define at least one outer ground contact 28*a*, and at least one up to all of the second plurality of columns 39*b* can define at least one outer ground contact 28*b*. The outer ground contacts 28*a-b* are illustrated as extending into the connector housing 22, for instance through a conductive support wall 50 of the connector housing 22, at a location spaced from the respective contact modules 23*a-b*. Alternatively, the outer ground contacts 28*a-b* can alternatively be supported by the respective bases 27 of the contact modules 23*a-b* in the manner described above with respect to the other ground contacts 28. In accordance with the illustrated embodiments, each of the outer ground contacts 28*a* and 28*b* are oriented such that their respective broadsides 54 face the edge 56 of the adjacent signal contact 26. In accordance with the illustrated embodiment, the outer ground contacts 28*a* of at least one up to all of the first plurality of columns 39*a* is disposed proximate to the first outer end 70*a*, and a select one of the signal contacts 26 of each of the first plurality of columns 39*a* is disposed proximate to the second outer end 70*b*.

Furthermore, in accordance with the illustrated embodiment, the outer ground contacts 28*b* of at least one up to all of the second plurality of columns 39*b* is disposed proximate to the second outer end 70, and a select one of the plurality of signal contacts 26 of each of the second plurality of columns 39*b* is disposed proximate to the first outer end 70*a*. It should be appreciated that while the respective contact modules 23*a* and 23*b* can define the same repeating S-S-G pattern of electrical contacts 38, the patterns can begin proximate to at opposite ends 70*a* and 70*b* of the respective columns 39*a* and 39*b* and extend in opposite directions along the respective columns 39*a* and 39*b*. Otherwise stated, the contact pattern of at least one first column 39*a* such as the first plurality of columns 39*a* along a first direction can be the same as the contact pattern of at least one second column 39*b* such as the second plurality of columns 39*b* along a second direction that is opposite the first direction. Alternatively, the first and second contact modules 23*a-b*, and the first and second columns 39*a-b*, can define the same contact pattern along the same direction from the first outer end 70*a* to the second outer end 70*b*, or can define different contact patterns as desired.

Because the leadframe housings 29 and the base 27 are insulative, the signal contacts 26 are electrically isolated from the ground contacts 28. Accordingly, the contact modules 23 prevent electrical signals from traveling from the signal contacts 26 to the ground contacts 28 both along the respective column 39 and across the columns 39 along the row direction 49.

Referring now to FIGS. 1-3 and FIG. 5, the support wall 50 supports the electrical contacts 38. In accordance with the illustrated embodiment, the support wall 50 directly supports the ground contacts 28 such that the ground contacts 28 are in direct physical contact with the support wall 50 at an interface 51. The support wall 50 can indirectly support the signal contacts 26. For instance, the support wall 50 can support the contact modules 23, which in turn support the signal contacts 26. The support wall 50 can be electrically conductive so as to place the ground contacts 28 in electrical communication with each other, both along the respective column directions 47 and the row directions 49. Accordingly, the array 61 of electrical contacts 38 are supported by the connector housing 22.

Figure 8:
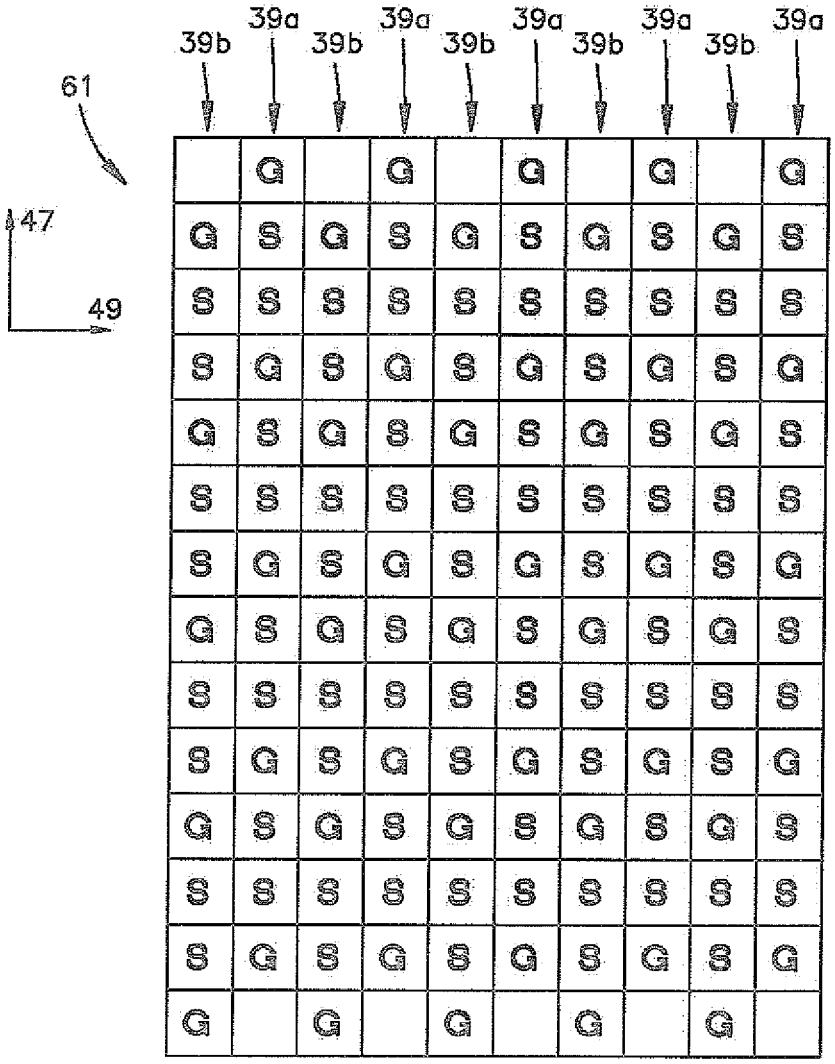
FIG. 8 is a schematic illustration of a footprint defined by the array of electrical contacts illustrated in FIG. 4.

Referring also to FIG. 8, the array 61 of electrical contacts 38 includes an array of ground contacts 28 spaced along the column direction 47 and the row direction 49, and an array of signal contacts 26 spaced along the column direction 47 and the row direction 49, such that select ground contacts 26 are disposed between select adjacent signal contacts 28. Otherwise stated, the array 61 of electrical contacts 38 is arranged in a plurality of columns 39 that extend along a respective column direction 47, wherein the columns 39 are spaced along a row direction 49 that extends substantially perpendicular to the column direction 47, and each of the columns 39 includes a plurality of signal contacts 26 and a plurality of ground contacts 28. The electrical connector 20 places the ground contacts 28 of the array 61 of electrical contacts 38 in electrical communication, while isolating the signal contacts 26 of the array 61 of electrical contacts 38 from the ground contacts 28. Accordingly, it should be appreciated that the ground contacts 28 are electrically isolated from the plurality of signal contacts 26 along the respective column, and the plurality of ground contacts 28 of each column 39 are in electrical communication with each other and with the ground contacts 28 of the other columns 39. For instance, the contact modules 23 can include select ones of the array of signal contacts 26 and select ones of the array of ground contacts 28 of the array 61 of electrical contacts 38, such that the select ones of the ground contacts 26 are in electrical communication with the connector housing 20.

In accordance with the illustrated embodiment, the connector housing 22 defines a plurality of first plurality of apertures 53 that extends through the support wall 50 and a second plurality of apertures 55 that extends through the support wall 50. The first plurality of apertures 53 is configured to receive the corresponding leadframe assemblies 25, and the second plurality of apertures 55 is configured to receive the corresponding ground contacts 28.

For instance, the first plurality of apertures 53 can be configured as slots that are elongate along the column direction 47, and are sized substantially equal to or slightly less than the leadframe housings 29 such that the leadframe housings 29 can be press-fit inside the apertures 53, or slightly greater than the leadframe housings 29 such that the leadframe housing 29 are received loosely in the apertures 53. In accordance with one embodiment, at least one or both of the support wall 50 and the leadrame housing 29 can include a retention member, such as a retention barb so as to engage the other of the support wall 50 and the leadframe housing 29 and provide a retention force at the interface between the leadframe housing 29 and the support wall 50 within the respective apertures 53 that resists removal of the leadframe housings 29 from the respective apertures 53. Because the signal contacts 26 are spaced from the outer perimeter of the leadframe housings 29, the signal contacts 26 are spaced from the support wall 50 when the leadframe housings 29 are disposed in the respective apertures 53.

The second apertures 55 can each define a cross-sectional dimension slightly less than or equal to that of the ground contacts 28 such that the ground contacts 28 can be press-fit in the apertures 55, or otherwise connect to the support wall 50 inside the apertures 55. In accordance with the illustrated embodiment, the ground contacts 28 can include second retention members in the form of one or more retention barbs 58 that project out from the ground contact body 57 and thus define an outer dimension slightly greater than the cross-sectional dimension of the respective ground contact body 57. Furthermore, the retention barbs 58 can define an outer dimension slightly greater than or substantially equal to the cross-sectional dimension of the apertures 55. Otherwise stated, the apertures 55 can have a cross-sectional dimension slightly less than or equal to the outer dimension of the retention barbs 58. Accordingly, the ground contacts 28 are configured to be press-fit in the apertures 55, which can be substantially cylindrical or can define any suitable alternative shape configured to retain the ground contacts 28.

It can thus be said that each of the ground contacts 28 can include at least a first retention member, such as the retention barb 42, that engages the base 27 inside the respective retention apertures 40, and at least a second retention member, such as the retention barb, that engages the support wall 50 inside the respective aperture 55. Thus, each of the plurality of ground contacts 28 of each of the respective contact modules 23 extends through respective ones of the second plurality of apertures 55 and is secured to the support wall 50 in the second plurality of apertures 55. In accordance with the illustrated embodiment, the second retention member is disposed above the first retention member.

Alternatively, the ground contacts 28 can be devoid of retention members that engage the support wall 50, and the support wall 50 can include retention members, such as barbs, that extend into the apertures 55 and engage the ground contact body 57 so as to retain the ground contacts 28 in the apertures 55. Alternatively, both or neither of the ground contacts 28 and the support wall 50 can include retention members that engage the other of the respective ground contacts 28 and the support wall 50 so as to retain the ground contacts 28 in their respective retention apertures 40. For instance, the ground contact body 57 can be sized substantially equal to or slightly greater than the respective apertures 55, and thus configured to be press-fit in the retention apertures 55.

It should be further appreciated that alternatively one or both of the leadframe assemblies 25 can be press-fit in their respective apertures 53 and 55, such that the contact modules 23 are reliably attached to, or press-fit in, the connector housing 22. For instance, as described above, the ground contacts 28 can be press-fit in the respective apertures 55 such that a substantially retention force prevents the inadvertent removal of the contact modules 23 from the connector housing, and the leadframe assemblies 25 can be loosely received in the respective apertures 53. Accordingly, it can be said that the ground contacts 28 fasten both themselves and at least one up to all of the leadframe assemblies 25 to the support wall 50, and therefore also to the connector housing 22.

When the electrical contacts 38 are supported by the support wall 50, the respective mating ends 31 extend above the support wall 50, and the mounting ends 33 of the ground contacts 28 are disposed below the support wall 50. The mating ends 31 of the ground contacts 28 can be inline with the mating ends 31 of the signal contacts 26, and the mounting ends 33 of the ground contacts 28 can be inline or offset with respect to the mounting ends 33 of the signal contacts 26.

Furthermore, the support wall 50 is conductive at least at the interfaces 51 with the ground contacts 26 and is further conductive between the interfaces 51 so as to place the ground contacts in electrical communication with each other. In accordance with the illustrated embodiment, the support wall 50 is made from a conductive material such as a conductive carbon, any suitable metal, or any suitable alternative conductive material, so that all electrical contacts 38 that are in contact with the support wall 50, or otherwise electrically connected to the support wall 50, such as the ground contacts 28, are commoned, or placed in electrical communication with each other as well as in electrical communication with the support wall 50.

Furthermore, a substantial entirety of the connector housing 22 can be electrically conductive, such that the ground contacts 28 are placed in electrical communication with the support wall 50 and the remainder of the connector housing 22.

Accordingly, the entire connector housing 22 can be electrically conductive or only the support wall 50 can be electrically conductive and the remainder of the connector housing 22 can be electrically insulateive. Because the signal contacts 26 are overmolded by the dielectric leadframe housing 29, the signal contacts 26 are electrically isolated from the support wall 50. Accordingly, the leadframe housing 29 electrically isolates the signal contacts 26 from the ground contacts 28 with respect to electrical communication through the support wall 50. Furthermore, because the spacer 27 is formed form an insulative material, the ground contacts 28 are electrically isolated with respect to the signal contacts 26 of a given contact module 23 along the respective column 39. It should be appreciated that the support wall 50 can be integral with the connector housing 22 or otherwise discreetly connected to the connector housing 22, such that the connector housing 22 includes the support wall 50. Thus, the connector housing 22, including the support wall 50, can be a unitary structure made of the same electrically conductive material.

It should thus be appreciated that certain components of the electrical connector 20 can be electrically conductive so as to place the ground contacts 28 in electrical communication with each other, and certain components of the electrical connector 20 can be electrically insulative so as to electrically isolate the ground contacts 28 from the signal contacts 26, and further to electrically isolate the signal contacts 26 from each other as well as from the ground contacts 28. The electrically conductive components of the connector 20, such as the support wall 50 alone or in addition to the remainder of the connector housing 22, can be wholly conductive or insulative with a conductive portion that is in electrical communication with (for instance can touch) the ground contacts 28 when the ground contacts 28 are mounted to the connector housing 22, for instance the support wall 50. Thus, the conductive portion can be a layer disposed on or embedded in insulative material of the support wall 50 alone or in combination with a conductive plating in the aperture in the support wall 50 that receives the ground contacts 28 and is electrically coupled to the layer so as to place the ground contacts 28 in electrical communication with each other. The conductive components or portion(s) of the conductive components can be made from any suitable electrically conductive material, and for instance can be diecast or otherwise formed from any suitable conductive metal, made from any suitable conductive plastic, metalized plastic, or made from a conductive lossy material as desired. As described above, the connector housing 22, or portions thereof, along with the base 27 and leadframe housings 25 can be made from any suitable electrically insulating material, such as a plastic or nonconductive lossy material, such as an Eccosorb® material commercially available from Emerson & Cuming.

The contact modules 23 are mounted to the connector housing 22 by inserting the upper mating ends 31 of the signal and ground contacts 26 and 28 of each contact module 23 up through the respective apertures 53 and 55 until the leadframe housings 25 are inserted into the apertures 53 and the ground contacts 28 are fastened to the support wall 50 in the respective apertures 55, such that the contact modules 23 are supported by the connector housing 22. The connector housing 22 can define slots 60 that extend from the bottom end 35*b* of the first and second end walls 32*a* and 32*b* up along the end walls 32*a-b*. For instance, the slots 60 can be aligned with, and sized to receive, the outer ground contacts 28*a-b* of the first and second pluralities of contact modules 23*a-b*. Accordingly, a first plurality of slots 60 can extend into the first end wall 32*a* at locations adjacent the respective first contact modules 23*a*, and thus configured to receive outer ground contacts 28*a* of the first contact modules 23*a*, and a second plurality of slots 60 can extend into the second end wall 32*b* at locations adjacent the respective second contact modules 23*b*, and thus configured to receive outer ground contacts 28*b* of the second contact modules 23*b*. Accordingly, the slots 60 can define a lateral width substantially equal to the broadsides 54 of the respective outer ground contacts 28*a-b*, such that the broadsides 54 are recited in the slots 60 as the contact modules 23*a-b* are mounted to the connector housing 22.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, those skilled in the art will realize that the invention is intended to encompass all modifications and alternative arrangements included within the spirit and scope of the invention, for instance as set forth by the appended claims.

What is claimed:

1. An electrical connector comprising:

a connector housing including a support wall that is at least partially electrically conductive;

at least one contact module including a plurality of signal contacts;

a plurality of ground contacts that are each configured to extend through the support wall, wherein when the at least one contact module is mounted to the connector housing, each of the plurality of ground contacts are placed in electrical communication with each other through the support wall, and the plurality of signal contacts remain electrically isolated from each of the plurality of ground contacts; and an electrically insulative base that supports both the plurality of signal contacts, and the plurality of ground contacts.

2. The electrical connector as recited in claim 1, wherein the at least one contact module extends along a column, and at least one of the plurality of ground contacts is disposed adjacent to the at least a pair of signal contacts along the column.

3. The electrical connector as recited in claim 2, wherein the at least one of the plurality of ground contacts is disposed between a first pair of adjacent signal contacts and a second pair of adjacent signal contacts along the column.

4. The electrical connector as recited in claim 3, wherein the at least one contact module further comprises a plurality of leadframe assemblies supported by the support wall, each of the leadframe assemblies including a leadframe housing that supports a respective pair of the plurality of signal contacts.

5. The electrical connector as recited in claim 4, wherein the leadframe housings are overmolded onto the respective pairs of the plurality of signal contacts.

6. The electrical connector as recited in claim 2, wherein the contact module is a first contact module, the plurality of ground contacts is a first plurality of ground contacts, and the plurality of signal contacts is a first plurality of signal contacts, and the electrical connector further comprises a second contact module including a second plurality of signal contacts and a second plurality of ground contacts that are electrically isolated both from each other and the second plurality of signal contacts in the contact module, wherein the second contact module is supported by the support wall at a location spaced from the first contact module such that each of the second plurality of ground contacts are in electrical communication with both each other and each of the first plurality of ground contacts.

7. The electrical connector as recited in claim 6, wherein the first and second contact modules extend along first and second columns, and the first column is offset with respect to the second column.

8. The electrical connector as recited in claim 6, wherein the first and second columns include respective outermost ground contacts, and the outermost ground contact of the first column is disposed at an opposite end with respect to the outermost ground contact of the second column.

9. The electrical connector as recited in claim 1, wherein the at least one contact module defines a plurality of retention apertures that extend through the base and each of the plurality of ground contacts extends through respective ones of the plurality of retention apertures and is secured to the base in the retention apertures.

10. The electrical connector as recited in claim 9, wherein the connector housing defines a second plurality of apertures that extend through the support wall, and each of the plurality of ground contacts extends through respective ones of the second plurality of apertures and is secured to the support wall in the second plurality of apertures.

11. The electrical connector as recited in claim 1, wherein the at least one contact module electrically isolates the included plurality of signal contacts.

12. An electrical connector comprising:

an electrically conductive connector housing;

a plurality of contact modules supported by the connector housing, the plurality of contact modules each including an electrically insulative base; and an array of electrical contacts supported by the connector housing, the array of electrical contacts arranged in a plurality of columns that extend along a respective column direction, wherein 1) the columns are spaced from each other along a row direction that extends substantially perpendicular to the column direction, and each of the columns includes a plurality of signal contacts of the array of electrical contacts and a plurality of ground contacts of the array of electrical contacts, 2) the plurality of ground contacts are electrically isolated from the plurality of signal contacts along the respective column, and the plurality of ground contacts of each column are in electrical communication with both each other and the ground contacts of the other columns, and 3) select ones of the plurality of signal contacts and ground contacts are supported by the base, such that the select ones of the ground contacts are in electrical communication with the connector housing.

13. The electrical connector as recited in claim 12, wherein the plurality of contact modules includes a first plurality of contact modules and a second plurality of contact modules alternatingly arranged with the first plurality of contact modules, wherein the first and second contact modules extend along respective columns and define the same contact pattern in opposite directions along their respective columns.

14. The electrical connector as recited in claim 12, wherein the select ones of the signal contacts defines a first pair of adjacent signal contacts and a second pair of adjacent signal contacts, and at least one of the select ones of the ground contacts is disposed between the first pair and the second pair along the column direction.

15. The electrical connector as recited in claim 14, wherein the at least one contact module further comprises a plurality of leadframe assemblies supported by the support wall, each of the leadframe assemblies including a leadframe housing that supports a respective pair of the select ones of the signal contacts.

16. The electrical connector as recited in claim 15, wherein the leadframe housings are overmolded onto the respective pairs of the plurality of signal contacts.

17. The electrical connector as recited in claim 12, wherein each of the contact modules defines a plurality of retention apertures that extend through the base, such that the respective select ones of the plurality of ground contacts extends through respective ones of the plurality of retention apertures and is secured to the base in the retention apertures.

18. The electrical connector as recited in claim 12, wherein the contact modules electrically isolate the select ones of the signal contacts from the select ones of the ground contacts.

* * * * *